US006857843B2

(12) United States Patent
Cummings et al.

(10) Patent No.: US 6,857,843 B2
(45) Date of Patent: Feb. 22, 2005

(54) GRAPPLING ASSEMBLY FOR EXCAVATING MACHINES

(75) Inventors: David C. Cummings, Crouse, NC (US); Samuel S. Pratt, Bedford, PA (US)

(73) Assignee: Rockland, Inc., Bedford, PA (US)

( * ) Notice: Subject to any disclaimer, the term of this patent is extended or adjusted under 35 U.S.C. 154(b) by 0 days.

(21) Appl. No.: 10/437,251

(22) Filed: May 14, 2003

(65) Prior Publication Data

US 2004/0228718 A1 Nov. 18, 2004

(51) Int. Cl.[7] ..... B66C 1/00

(52) U.S. Cl. ..... 414/729; 37/706; 414/724; 414/912

(58) Field of Search ..... 414/729, 724, 414/912; 37/403, 406, 903

(56) References Cited

U.S. PATENT DOCUMENTS 3,353,285 A * 11/1967 Murray ..... 37/406
4,932,832 A * 6/1990 McCasland et al. .... 414/732 X
6,203,267 B1 * 3/2001 Heiple et al. ..... 414/722
6,640,471 B2 * 11/2003 Desrochers ..... 37/406

* cited by examiner

*Primary Examiner*—Donald W. Underwood
(74) *Attorney, Agent, or Firm*—Stevens, Davis, Miller & Mosher, LLP

(57) ABSTRACT

An assembly mountable on the dipper stick of a machine, having a bucket pivotally connected thereto and means operatively interconnecting the dipper stick and the bucket for curling and uncurling the bucket, cooperable with the bucket when mounted on the dipper stick for grappling objects generally including an arm member pivotally connectable at one end thereof to the underside of the dipper stick, depending freely therefrom and swingable in a substantially vertical plane, and having a length sufficient to be received within the bucket opening when the arm member is connected to the dipper stick and is depending freely therefrom and the bucket is curled as in performing an excavating function and a chain connectable at one end to the underside of the dipper stick and at another end thereof to the arm member.

38 Claims, 4 Drawing Sheets

GRAPPLING ASSEMBLY FOR EXCAVATING MACHINES

This invention relates to an assembly mountable on the dipper stick on an excavating machine, cooperable with a bucket thereof for grappling objects such as tree trunks, logs, branches, boulders and the like. The invention further contemplates such as an assembly which may be permanently mounted on such a machine, permitting the machine to be operated in either the excavating or grappling mode without having to repeatedly attach and detach the assembly.

BACKGROUND OF THE INVENTION

In the prior art, there has been developed an arm and chain assembly mountable on the dipper stick of a machine, cooperable with a bucket of the machine for grappling various objects. Such an assembly is illustrated and described in U.S. Pat. No. 3,613,922.

Such prior art assembly is intended to be detachably mounted on the dipper stick of a machine normally used for excavating functions. Whenever it is desired to excavate an area littered with various objects such as tree trunks, branches, boulders and the like, the assembly is attached to the dipper stick of the machine and the machine is operated to grapple and remove such objects. When the area has been cleared of such objects, the attachment is intended to be removed and the machine is operated in the conventional manner to excavate.

Although the assembly as described may be seen to be advantageous for clearing an area to be excavated, its requirement to be attached and detached when switching back and forth between grappling and excavating modes is highly disadvantageous in that it adversely affects the productivity of the machine. Accordingly, it is the principal object of the present invention to provide an assembly mountable on an excavating machine and cooperable with the bucket of the machine to grapple various objects in clearing an area, which may be permanently mounted on the machine, permitting the machine to be used in either the grappling or excavating mode. It is a further object of the present invention to provide such a permanently mounted assembly in which the assembly will not interfere with the excavator when the machine is operated in the excavating mode.

SUMMARY OF THE INVENTION

The present invention provides an improvement over the prior art as described by providing such as assembly comprising an arm member pivotally connectable at one end thereof to the underside of the dipper stick of an excavating machine, depending freely therefrom and swingable in substantially a vertical plane and having a length sufficient to be received within the material receiving opening of the bucket when the arm member is connected to dipper stick and is depending freely therefrom and the bucket is curled as in performing an excavating function, and a chain connectable at one end to the underside of the dipper stick and at another end thereof to the arm member. With such an arrangement, while the arm member is mounted on the dipper stick and the bucket is curled in the conventional manner in scooping a load of material, the free end of the arm member will freely be received within the material receiving opening of the bucket. Whether the bucket is being curled to receive a load of material or uncurled to dump such material, the free end of the arm member received within the bucket will not interfere with either of such operations. Preferably, the arm member is formed of a first section pivotally connected to the underside of the dipper stick and a second section pivotally connected to the first section, and biasing means operatively interconnecting the two sections is provided for biasing such sections into longitudinal alignment relative to each other.

DETAILED DESCRIPTION OF THE PREFERRED AND ADDITIONAL EMBODIMENTS OF THE INVENTION

Figures 1, 2, 3, 3A, 3B:
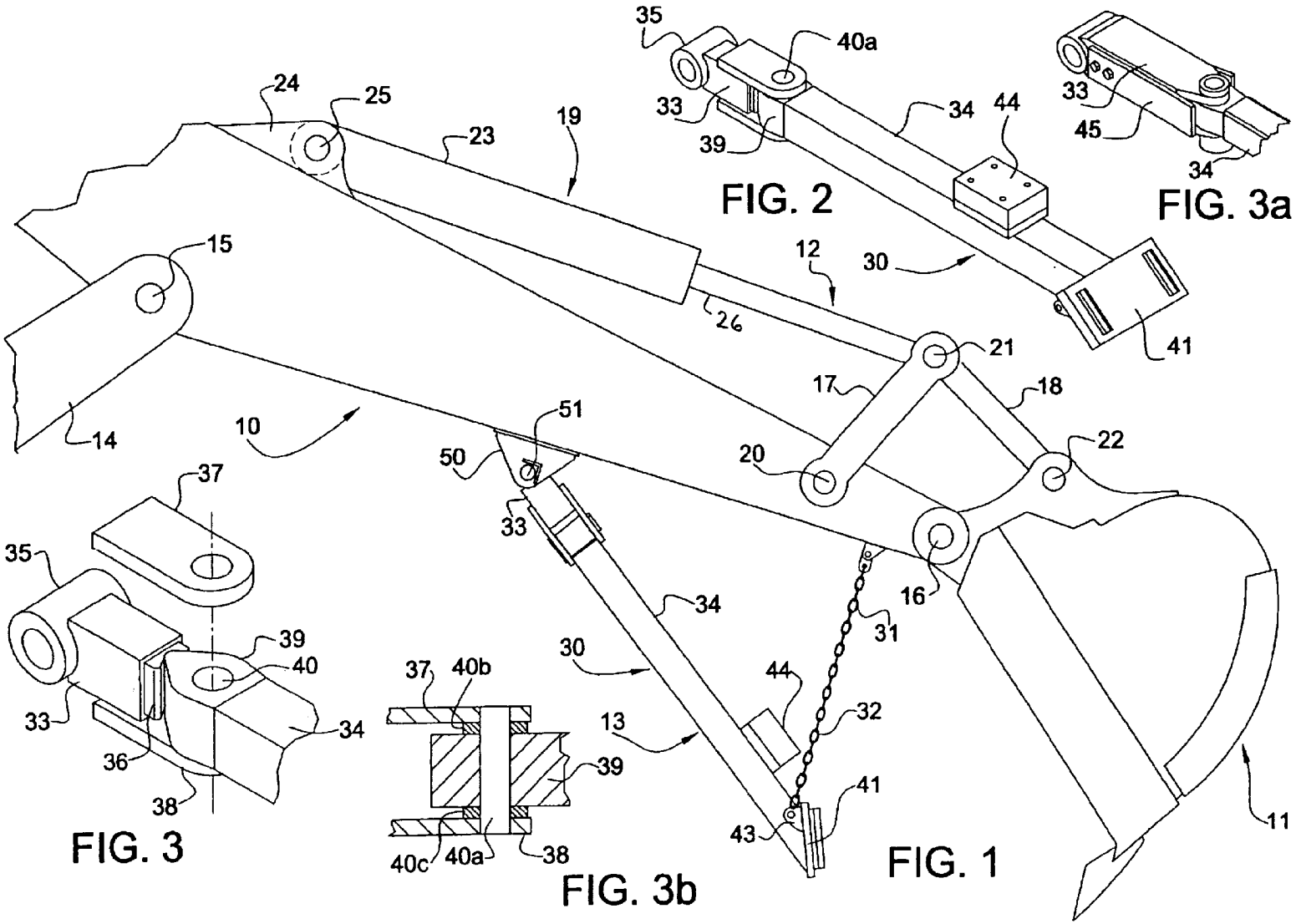
FIG. 1 is a side elevational view of the front end assembly of an excavating machine provided with an assembly embodying the present invention.
FIG. 2 is a perspective view of an arm member comprising a component of the assembly shown in FIG. 1.
FIG. 3 is an enlarged, fragmentary view of a portion of the arm member shown in FIG. 2 illustrating a component thereof in exploded relation.
FIG. 3*a* is a fragmentary portion of a modification of the arm member shown in FIG. 2, illustrating an alternate means for biasing the component thereof in longitudinal alignment.
FIG. 3*b* is an enlarged, vertical cross-sectional view of the upper end the arm member shown in FIG. 2, illustrating the use of a set of friction washers for retarding the pivotal displacement of the lower arm section from the upper arm section.
Figure 4:
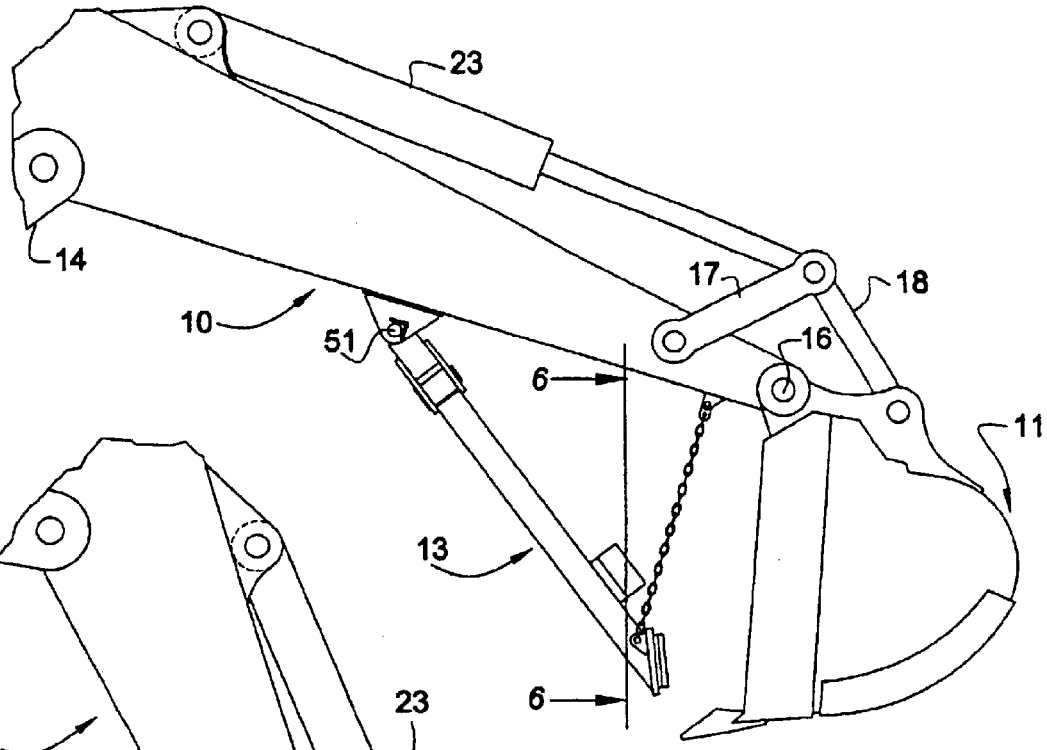
FIG. 4 is a view similar to the view shown in FIG. 1, illustrating the bucket in a curled position greater than the position of the bucket shown in FIG. 1.

Referring to FIG. 1, there is shown a front end assembly of an excavating machine which generally includes a dipper stick 10, a bucket 11, an actuating assembly 12 and a grappling assembly 13. In the conventional manner, dipper stick 10 is pivotally mounted to a boom 14 of the machine by means of a pin or set of pins 15 to permit the dipper stick to be pivoted about a substantially horizontal axis of pin or pins 15. The lower end of the boom is pivotally connected to the front end of the main frame of the machine, and an actuating assembly operatively interconnects the boom and the upper end of the dipper stick for pivoting the dipper stick about the axis of connected pin or pins 15. Similarly, an actuating assembly operatively interconnects the main frame of the machine and the boom for lifting and lowering the boom. Bucket 11 is pivotally connected to the free end of the dipper by means of a connecting pin 16. Actuating assembly 12 is also of a conventional construction including a pair of support links 17, 17, a pair of tilt links 18, 18 and a hydraulic cylinder assembly 19. Support links 17, 17 are mounted on the side walls of the dipper stick adjacent connecting pin 16, by means of connecting pins 20, 20 and are connected at their free ends to a connecting pin 21. Tilt links 18, 18 are pivotally connected at one set of ends to connecting pin 21 and pivotally connected at the opposite set of ends thereof to bucket 11 at points spaced from connecting pin 16, by means of a connecting pin 22. Cylinder assembly 19 includes a cylinder member 23 connected at a base end thereof to a set of brackets 24, 24 mounted on the upper side of the dipper stick by means of a connecting pin 25, and a rod member 26 connected at its free end to connecting pin 21. In the conventional manner, cylinder assembly 19 may be operated to curl and uncurl bucket 11 about the axis of connecting pin 16.

Figure 6:
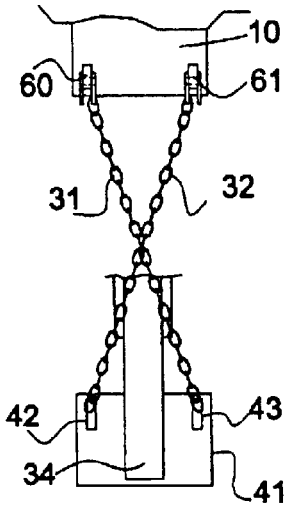
FIG. 6 is an enlarged, cross sectional view taken along line 6—6 in FIG. 4.

Assembly 13 generally includes an arm member 30 and a set of chains 31 and 32 as best seen in FIG. 6. The arm member consists of an upper arm section 33 and a lower arm section 34. As best seen in FIGS. 1, 2 and 3, upper arm member 33 consists of a comparatively short box beam member secured at one end to a tubular element 35, and has an open, opposite end in which there is provided a resilient element 36 having a V-shaped recess providing a pair of opposed diverging walls. Rigidly mounted on the upper and lower sides thereof is a set of connecting plates 37 and 38 provided with a set of aligned, pin receiving openings having an axis disposed in a plane perpendicular to the axis of tubular element 35. Lower arm member 34 is of a box beam construction similar to the construction of upper arm section 33 and includes a rigidly connected end element 39 received between connecting plates 37 and 38, having a converging front end portion configuration received within the recess of resilient member 36 and having opening 40 therein for receiving a connecting pin therethrough and the registered openings in connecting plates 37 and 38 to pivotally connect lower arm section 34 to upper arm section 33.

Mounted on the free end of lower arm section 34 is a pad 41 which lies in a plane at an acute angle relative to the longitudinal centerline of lower arm section 34. As best seen in FIG. 6, pad 40 has a substantially rectangular configuration and is provided with a set of connecting brackets 42 and 43 on a rear side thereof. Also mounted on the upper side of lower arm section 34 adjacent pad 41 is a bumper 44 formed of rubber or other suitable cushioning material.

The upper end of arm member 30 is connected to a set of depending brackets 50, 50 rigidly secured to the underside of the dipper stick at a point spaced from connecting pin 16 by means of a connecting pin 51 to permit the arm member to freely swing in a vertical plane below the dipper stick about the substantially horizontal axis of connecting pin 51. The opposite end of the arm member is connected to the underside of the dipper stick at a point adjacent to connecting pin 16 by chain 31 connected at an upper end to a depending bracket 60 provided on the underside of the dipper stick and at the other end to bracket 43. Chain 32 similarly is connected at one end to a depending bracket 61 provided on the dipper stick and at an opposite end to bracket 42 on pad 41 so the chains crisscross as shown in FIG. 6.

Figure 5:
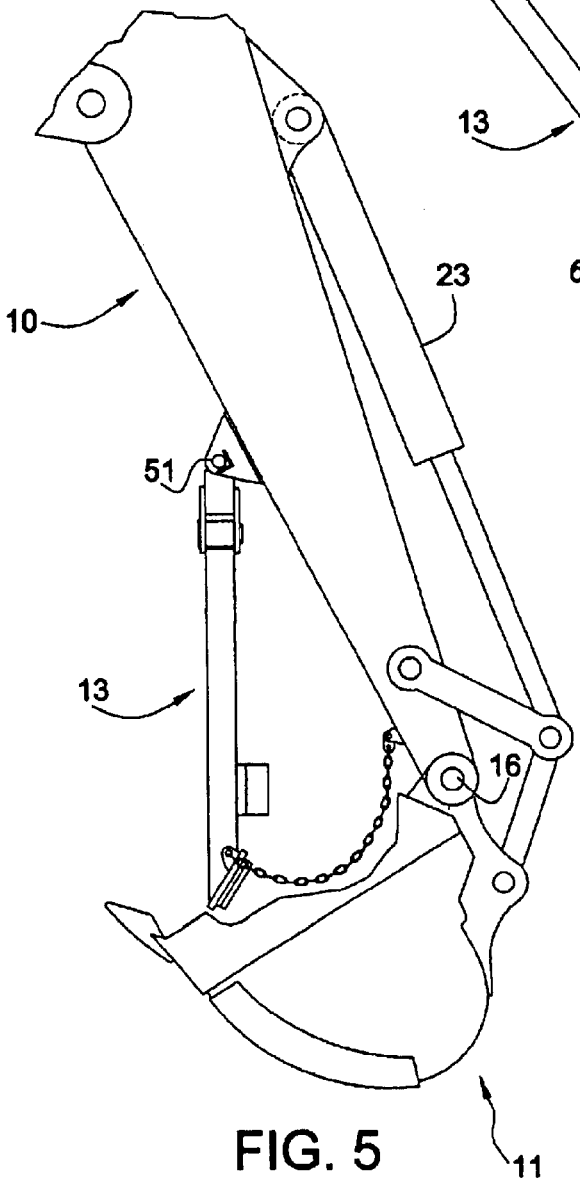
FIG. 5 is a view similar to the view shown in FIG. 4, illustrating the bucket in a curled position greater than the position of the bucket shown in FIG. 4.

As perhaps best seen in FIG. 5, the length of the arm member measured from the axis of connecting pin 51 to the free end of the arm member is greater than the distance between connecting pin 51 and connecting pin 16 of the bucket so that when the dipper stick is pivoted downwardly and the bucket is curled as in an excavating or scooping motion, the free end of the arm member hanging freely from the dipper stick will be received within the material receiving opening of the bucket perhaps along with material received within the bucket.

In the use of the embodiment as described, whenever it is desired to grapple, lift and remove an object such as a rock or boulder in clearing an area to be excavated, the bucket may be uncurled and the dipper stick may be maneuvered essentially in the position as shown in FIG. 1 to allow chains 31 and 32 to be fully extended and positioned adjacent the object to be grappled. Cylinder assembly 19 may then be operated to curl the bucket and thus seize the object between chains 31 and 32 and the bucket. The boom and dipper stick along with other controls on the machine then may be operated to lift the object, transport it to another site and release it. After such ground clearing operation has been completed and it is desired to excavate the cleared area, the machine may be used in the conventional manner to scoop and remove material with the bucket. In such mode of operation as the bucket curls, the free end of the arm member will simply dangle from the dipper stick and be received within the material receiving opening of the bucket. Thus freely being received within the bucket, the arm member will not interfere with the normal movements of the bucket in curling and uncurling during the excavating operation.

In the grappling mode of the invention, side loads often will be imposed on the arm member which in designs of the prior art could result in breakage or bending of the arm member. In the present invention, the pivotal connection between the upper and lower arm sections permits the lower arm section to be displaced transversely under laterally applied loads without bending or breaking. In displacing laterally, however, end element 39 of the lower arm section will be caused to engage and compress a portion of resilient element 36 of the upper arm portion to cause the lower arm section to swing back into longitudinal alignment with the upper arm section under the biasing action of resilient element 36 when the laterally applied load is removed. In addition to the means shown in FIG. 3 for biasing the lower arm section in longitudinal alignment with the upper arm section, other biasing means may be provided to produce the same effect. As an example, leaf springs may be mounted on one of the sections and engage the other section to bias the sections into longitudinal alignment, as shown in FIG. 3*a*. A pair of leaf springs 45 are rigidly secured to one set of sides of one arm section and have an opposite set of ends engaging the sides of the other arm section thus biasing the sections into longitudinal alignment. Also, connecting pin 40*a* may be provided with friction washers or Bellville washers to retard angular displacement of the lower arm section relative to the upper arm section. FIG. 3*b* illustrates the use of a pair of friction washers 40*b* and 40*c* which may be Bellville or other types of friction washers capable of retarding the pivotal movement of arm section 34 relative to arm section.

Figure 7:
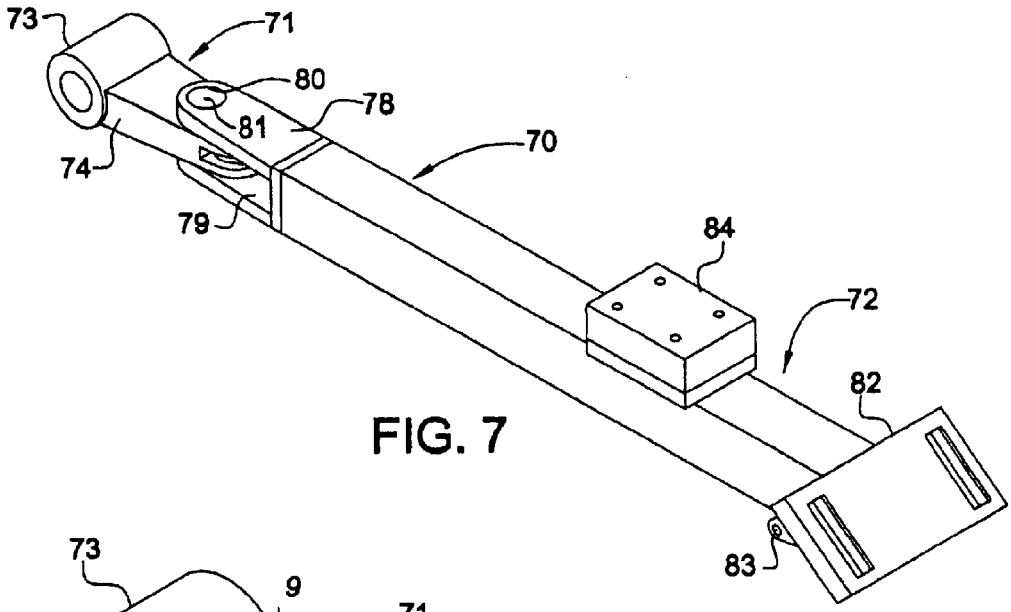
FIG. 7 is a perspective view of a modification of the arm member shown in FIG. 2.
Figure 8:
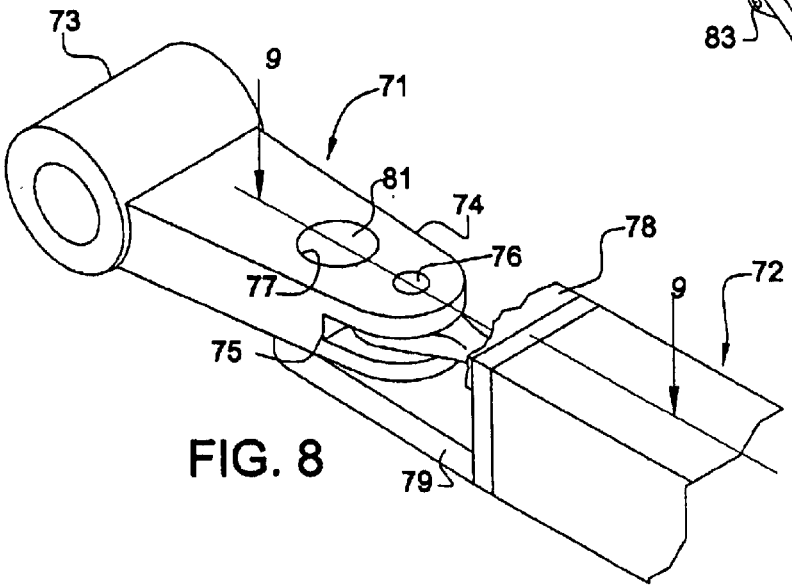
FIG. 8 is an enlarged, fragmentary view of a portion of the arm member shown in FIG. 7 having a portion thereof broken away.
Figure 9:
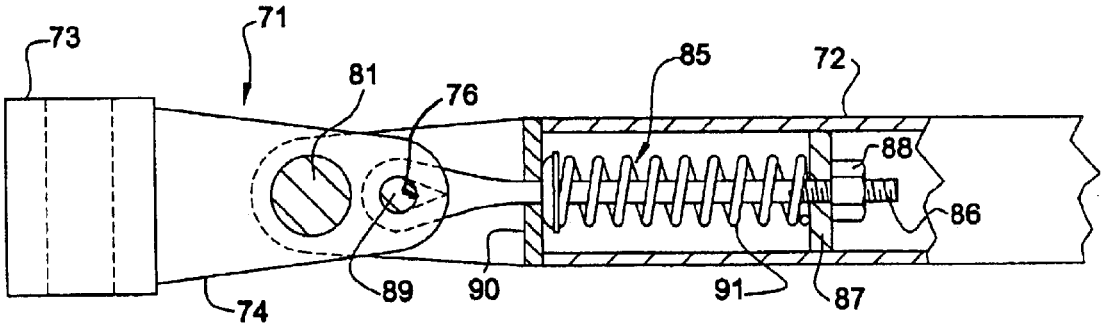
FIG. 9 is a cross sectional taken along line 9—9 in FIG. 8.

FIGS. 7 through 9 illustrates an arm member 70 which is a modification of arm member 30. Such modified arm member consists of an upper arm section 71 and a lower arm section 72. Upper arm member 71 includes a tubular portion 73 and a portion 74 disposed substantially radially relative to the axis of tubular portion 73, and having a recess 75 at the free end thereof to provide a bifurcated end portion. The bifurcated end of section 74 includes a pair of aligned pin receiving openings 76, and the portion thereof between tubular section 73 and the bifurcated end thereof is provided with a pin receiving opening 77. Lower arm section 72 is of a box beam construction similar to lower arm member 34 and includes a pair of projecting plate sections 78 and 79 provided with aligned openings 80, 80 adapted to register with opening 77 in the upper arm section and receive a connecting pin 81 to pivotally connect the lower arm section to the upper arm section about the axis of connecting pin 81. Mounted on the free end of lower arm section 72 is a pad 82 which lies in a plane at an acute angle relative to the longitudinal center line of the lower arm section. The pad has a substantially rectangular configuration and is provided with a set of connecting brackets 83, 83 on a rear side thereof for connecting a set of chains similar to chains 31 and 32. Tubular portion 73 is adapted to be pivotally connected to a set of brackets depending from the underside of the dipper similarly as shown in FIG. 1. Also mounted on the upper side of the lower arm section adjacent pad 82 is a bumper 84 formed of rubber or another suitable cushioning material which is similar in construction and function to those of bumper 44.

Figure 10:
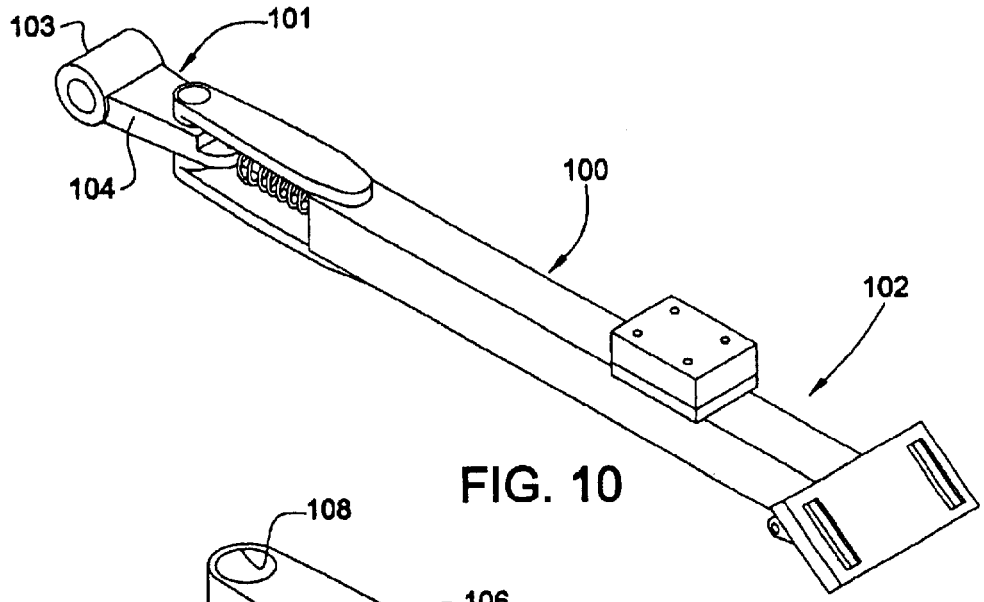
FIG. 10 is a perspective view of another embodiment of the arm member shown in FIG. 2.

As best seen in FIG. 9, lower arm section 72 is biased in a position disposed substantially in longitudinal alignment with upper section 71 and substantially radially relative to The modified arm members shomn in FIGS. 7 and 10 function in essentially the same manner. One of such modifications utilizes a spring a spring under tension and the other simply uses a spring in compression.

Figure 6A:
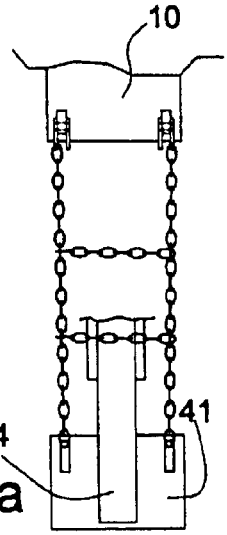
FIG. 6*a* is a view similar to the view shown in FIG. 6, illustrating a modification of the chain portion of the arrangement shown in FIG. 6.

Although two claims are utilized in the embodiment described, a single change also may be used. In addition, in lieu of the two chains being crisscrossed, they may be arranged in spaced apart relation with interconnecting portions as shown in FIG. 6*a*.

With a grapple assembly of the type described, a machine operator may clear an area to be excavated by grappling and repositioning objects strewn in the area, and immediately begin excavating without any down time or reconfiguring the front end assembly of the machine, thus enhancing its productivity.

From the foregoing detailed description, it will be evident that there are a number of changes, adaptations and modifications of the present invention witch come within the province of those having ordinary skill in the art to witch aforementioned invention pertains. However, it is intended that all such variations not departing from the spirit of the invention be considerd as within the scope thereof, limited solely by the appended claims. the axis of tubular portion 73 of section 71 by a spring assembly 85. Such assembly includes an elongated bolt 86, a loose plate 87 and a nut 88. Bolt 86 is provided with an opening or eye at one end thereof registrable with aligned openings 76, 76 in the bifurcated portion of the upper arm section, and adapted to receive a pin 89 therethrough to pivotally connect bolt 86 and correspondingly the lower arm section to the upper arm section for pivotal movement about the axis of connecting pin 89, a shank portion extending through aligned openings in end wall 90 of the lower arm section and an opening in plate member 87, and a threaded end portion. Nut 88 is threaded on the threaded end portion of the bolt and spring 91 encompasses the intermediate shank portion of the bolt and is interposed between fixed end wall 90 and movable plate 87. The force of spring 91 acting on bolt 86 through plate member 87 functions to bias the lower arm section into longitudinal alignment with the upper arm section, substantially radially to the axis of tubular portion 73. As the lower arm section is caused to pivot about the axis of connecting pin 89 during use of the arm member, spring 91 acting on bolt 86 will cause the lower arm member to swing back into longitudinal alignment with the upper arm section.

Figure 11:
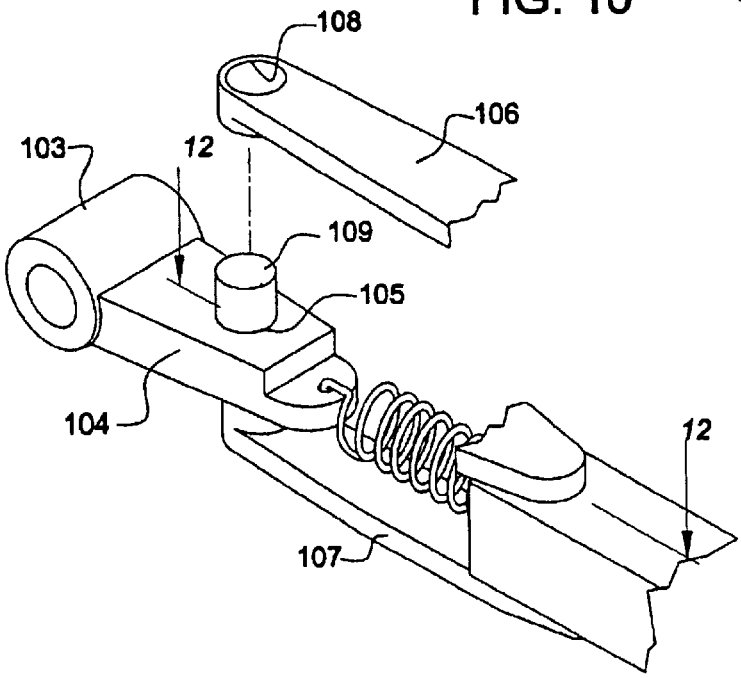
FIG. 11 is an enlarged, fragmentary of a portion of the arm member shown in FIG. 10, illustrating a component thereof in exploded relation.
Figure 12:
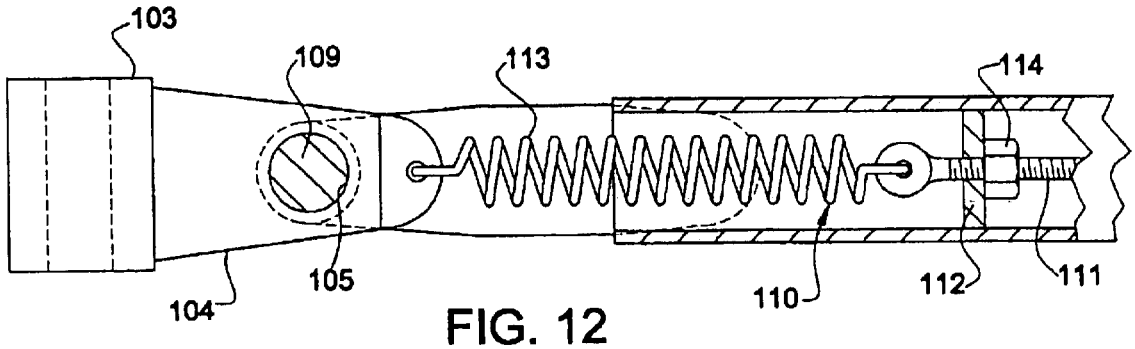
FIG. 12 is a cross sectional view taken along line 12—12 in FIG. 11.

Arm member 100 shown in FIGS. 10 through 12 is another modification of arm member 30 shown in FIG. 2. It also functions in a manner similar to the manner of arm member 30 or arm member 70. It includes an upper arm section 101 and a lower arm section 102. The upper arm section consists of a tubular portion 103 comparable to tubular portions 35 and 73 and adapted to be connected to the underside of the dipper stick as shown in FIG. 1, and a portion 104 disposed substantially radially relative to the axis of tubular portion 103 and having an opening 105. Lower arm section 102 is of a box beam construction having an open rear end and a pair of rearwardly projecting, parallel connecting plates 106 and 107. Provided in the ends of plates 106 and 107 is a pair of aligned openings 108, 108 adapted to register with opening 105 in upper arm section 104 and receive a connecting pin 109 therethrough and thus pivotally connect the lower arm section to the upper arm section for pivotal movement of the lower arm section about the axis of connecting pin 109. The lower arm section is biased into longitudinal alignment with the upper arm section as shown in FIG. 12 by means of a spring assembly 110. Such assembly includes a threaded eye-bolt 111 extending through a fixed partition wall 112 in the lower arm section, a spring 113 connected at one end to the free end of the upper arm section and connected at the opposite end to the eye portion of the bolt and a nut 113 threaded on the end of bolt 111 and engaging partition wall 112 under the force of the spring. In use, it will be appreciated that whenever the lower arm section is caused to move from side to side about the axis of connecting pin 109, spring 113 acting on partition wall 112 will cause the lower arm section to be biased back into longitudinal alignment with the upper arm section.

The modified arm members shown in FIGS. 7 and 10 function in essentially the same manner. One of such modifications utilizes a spring under tension and the other simply uses a spring in compression.

Although two chains are utilized in the embodiment described, a single change also may be used. In addition, in lieu of the chains being crisscrossed, they may be arranged in spaced apart relation with interconnecting portions as shown in FIG. 6*a*.

With a grapple assembly of the type described, a machine operator may clear an area to be excavated by grappling and repositioning objects strewn in the area, and then immediately begin excavating without any down time or reconfiguring the front end assembly of the machine, thus enhancing its productivity.

From the foregoing detailed description, it will be evident there are a number of changes, adaptations and modifications of the present invention which comes within the province of those having ordinary skill in the art to which the aforementioned invention pertains. However, it is intended that all such variations not departing from the spirit of the invention be considered as within the scope thereof, limited solely by the appended claims.

We claim:

1. An assembly mountable on the boom of a machine for selectively performing excavating and grappling functions, comprising:

a dipper stick operatively connectable to said boom;

a bucket pivotally connected to an end of said dipper stick, having a material receiving opening;

means operatively interconnecting said dipper stick and said bucket for curling and uncurling said bucket;

an arm member pivotally connected to an underside of said dipper stick, depending freely therefrom, and swingable in a substantially vertical plane and having a length sufficient to be received within said opening of said bucket when said bucket is curled as in performing an excavating function; and a chain connected at one end to said underside of said dipper stick and at another end thereof to said arm member;

whereby when said assembly is operated in a grappling mode, objects may be grappled by maneuvering said chain in an extended condition against a side of an object and then curling said bucket to seize said object between said chain and said bucket, and when said assembly is operated in an excavating mode, the free end of said arm member may be received within said bucket opening without interfering with the entry or discharge of material thereinto or therefrom.

2. An assembly according to claim 1 wherein said arm member includes a pad on the free end thereof which may engage an object being grappled.

3. An assembly according to claim 1 wherein said arm member includes a bumper engageable with said underside of said dipper stick.

4. An assembly according to claim 1 wherein said arm member includes a first section connected to said dipper stick for pivotal movement about a first axis and a second section connected to said first section for pivotal movement about a second axis displaced angularly relative to said first axis.

5. An assembly according to claim 4 wherein said first axis is substantially horizontal and said second axis lies in a plane substantially perpendicular to said first axis.

6. An assembly according to claim 4 including means for biasing said first and second sections of said arm member into longitudinal alignment.

7. An assembly according to claim 6 including a resilient member mounted on one of said arm member sections and having a recess provided with a pair of opposed diverging walls, and wherein an end portion of the other of said arm member sections is received in said recess and engageable with said diverging recess walls which function upon contact and suppression thereof to urge said end portion into longitudinal alignment with the other of said arm member sections.

8. An assembly according to claim 6 wherein said biasing means comprises a pair of leaf springs each rigidly mounted on one of said arm member sections and having a portion engaging a portion of said other arm member section for urging said other arm member section into longitudinal alignment with said one arm member section.

9. An assembly according to claim 6 wherein said biasing means includes a resilient portion of said second section.

10. An assembly according to claim 4 wherein said second pivotal connection includes a set of friction washers.

11. An assembly according to claim 4 wherein said second pivotal connection includes a set of Bellville washers.

12. An assembly according to claim 1 wherein one end of said chain is connected to said dipper stick adjacent the pivotal connection of said bucket to said dipper stick, and the other end thereof is connected to said arm member adjacent a free end thereof.

13. An assembly according to claim 1 including a pair of chains having one set of ends connected to said dipper stick and an opposite set of ends connected to said arm member.

14. An assembly according to claim 13 wherein said chains are arranged in a crisscrossed manner.

15. An assembly according to claim 13 wherein said chains are arranged in spaced apart relation.

16. An assembly according to claim 15 including at least a third chain linking said first and second mentioned chains.

17. An assembly mountable on a dipper stick of machine, having a bucket pivotally connected thereto and means operatively interconnecting said dipper stick and said bucket for curling and uncurling said bucket, cooperable with said bucket when mounted on said dipper stick for grappling objects, comprising:

an arm member pivotally connectable at one end thereof to said underside of said dipper stick, depending freely therefrom and swingable in a substantially vertical plane, and having a length sufficient to be received within said bucket opening when said arm member is connected to said dipper stick and is depending freely therefrom and said bucket is curled as in performing an excavating function; and a chain connectable at one end to said underside of said dipper stick and connected at another end thereof to said arm member;

whereby when said assembly is mounted on said dipper stick and operated in a grappling mode, objects may be grappled by maneuvering said chain against a side of an object to be grappled and then curling said bucket to seize said object between said chain and said bucket, and when said assembly is mounted on said dipper stick and operated in an excavating mode, the free end of said arm member will be received within said bucket opening without interfering with the entry or discharge of material thereinto or therefrom, respectively.

18. An assembly according to claim 17 wherein said arm member includes a pad on the free end thereof which may engage an object being grappled.

19. An assembly according to claim 17 wherein said arm member includes a bumper engageable with said underside of said dipper stick.

20. An assembly according to claim 17 wherein said arm member includes a first section connectable to said dipper stick for pivotal movement about a first axis and a second section connected to said first section for pivotal movement about a second axis displaced angularly relative to said first axis.

21. An assembly according to claim 20 including means for biasing said first and second section of said arm member into longitudinal alignment.

22. An assembly according to claim 21 including a resilient member having a recess provided with a pair of opposed, divergent walls, mounted on one of said arm member sections, and wherein an end portion of the other of said arm member sections is received in said recess and engageable with said divergent, recess walls which function upon engagement and suppression thereof to urge said end portion into longitudinal alignment with said other arm member section.

23. An assembly according to claim 21 wherein said biasing means comprises a pair of leaf springs each rigidly mounted on one of said arm member sections and having a portion engaging a portion of said other arm member section for urging said other arm member section into longitudinal alignment with said one section.

24. An assembly according to claim 21 wherein said biasing means includes a resilient portion of said second arm member section.

25. An assembly according to claim 20 wherein said second pivotal connection includes a set of friction washers.

26. An assembly according to claim 20 wherein said second pivotal connection includes a set of Bellville washers.

27. An assembly according to claim 17 wherein one end of said chain is connectable to said dipper stick adjacent the pivotal connection of said bucket to said dipper stick, and the other end thereof is connected to said arm member adjacent a free end thereof.

28. An assembly according to claim 17 including a pair of chains having one set of ends connectable to said dipper stick and an opposite set of ends connected to said arm member.

29. An assembly according to claim 28 wherein said chains are arranged in a crisscrossed manner.

30. An assembly according to claim 28 wherein said chains are connected to said arm member and connectable to said dipper stick in spaced apart relation.

31. An assembly according to claim 30 including at least a third chain linking said first and second mentioned chains.

32. An assembly according to claim 17 wherein the length of said arm member is greater than the distance between the point on the dipper stick at which an end of said arm member is connectable and the axis of the pivotal connection of said bucket to said dipper stick.

33. An assembly according to claim 6 wherein said biasing means comprises a spring operatively connecting said first and second arm section.

34. An assembly according to claim 33 wherein said spring is in tension.

35. An assembly according to claim 33 wherein said spring is in compression.

36. An assembly according to claim 21 wherein said biasing means comprises a spring operatively connecting said first and second arm sections.

37. An assembly according to claim 36 wherein said spring is in tension.

38. An assembly according to claim 36 wherein said spring is in compression.

* * * * *

UNITED STATES PATENT AND TRADEMARK OFFICE

CERTIFICATE OF CORRECTION

PATENT NO. : 6,857,843 B2
DATED : February 22, 2005
INVENTOR(S) : Cummings et al.

It is certified that error appears in the above-identified patent and that said Letters Patent is hereby corrected as shown below:

Column 5,
Line 27, delete beginning with "The modified arm members" through line 50 ending at "solely by the appended claims."

Signed and Sealed this

Tenth Day of January, 2006

JON W. DUDAS
*Director of the United States Patent and Trademark Office*